United States Patent [19]

Kawasaki

[11] 4,146,348

[45] Mar. 27, 1979

[54] METHOD FOR EXECUTING IMPERMEABLE CONSTRUCTION JOINTS FOR DIAPHRAGM WALLS

[75] Inventor: Kenji Kawasaki, Suita, Japan

[73] Assignee: Konoike Construction Co., Ltd., Osaka, Japan

[21] Appl. No.: 852,524

[22] Filed: Nov. 17, 1977

[30] Foreign Application Priority Data

Dec. 8, 1976 [JP] Japan ..... 51-148081

[51] Int. Cl.[2] ..... E02D 5/20

[52] U.S. Cl. ..... 405/267; 405/236

[58] Field of Search ..... 61/35, 39, 53.74, 53.64, 61/53.66, 53.56

[56] References Cited

U.S. PATENT DOCUMENTS

| | | | |
|---|---|---|---|
| 3,410,095 | 11/1968 | Turzillo et al. | 61/35 |
| 3,893,302 | 7/1975 | Peterson | 61/35 |

FOREIGN PATENT DOCUMENTS

| | | | |
|---|---|---|---|
| 400633 | 1/1967 | Australia | 61/35 |
| 1441473 | 6/1976 | United Kingdom | 61/35 |

*Primary Examiner*—Jacob Shapiro

*Attorney, Agent, or Firm*—Wenderoth, Lind & Ponack

[57] ABSTRACT

A method for constructing continuous concrete walls free from water leakage under the ground, wherein upon hardening of the concrete of a preceding wall panel the space for the next succeeding wall panel is excavated and while placing a reinforcing steel cage in the space for the next succeeding wall panel, at least one injection pipe is inserted along with the steel cage; placing of concrete in this section Portland cement suspension is jetted at a high pressure from a nozzle of the injection pipe, which is pulled up as it is rotated, whereby clay or slime of bentonite or the like between the end faces of adjacent concrete walls is removed by the fracturing and agitating effect of the jet.

4 Claims, 12 Drawing Figures

METHOD FOR EXECUTING IMPERMEABLE CONSTRUCTION JOINTS FOR DIAPHRAGM WALLS

This invention relates to a method for forming impermeable construction joints for diaphragm walls.

In constructing an underground structure, it is the usual practice first to build retaining walls at the borders of the excavation in order to minimize the quantity of earth to be excavated and to prevent the lateral movement of adjacent ground. However, in carrying out engineering works or in constructing a building in an urban area, a constructing method which is free from both vibration and noise has been required to eliminate construction pollution. Also, in view of the limited strength of retaining walls, when excavation is carried out to a great depth an underground continuous wall constructing method of a so-called diaphragm wall method has been increasingly employed. This constructing method is called by different names according to the type of excavator to be used but the basic method of execution and procedures of this prior art method is as diagrammed in FIG. 1. More particularly, a trench is excavated in the ground as deep as 1–1.5 meters, in which two concrete walls 1 (hereinafter referred to as "guide walls"), each about 20 c.m. in thickness, are placed with a space between them which is somewhat larger than the thickness of the required diaphragm walls to be constructed. Then, a trench for the first wall panel 2 is excavated to the desired depth and with a length of 6–10 meters. However this case, in order to prevent the lateral movement of adjacent ground, the excavation is filled with a suspension of bentonite in muddy water up to the top of the guide walls in order to support the wall faces of the trench by the hydraulic pressure of the suspension which has a high specific gravity.

Upon finishing of the excavation for the first panel 2, settled soil particles and slime in the trench are removed and interlocking pipes 4 are inserted in both ends of the trench as shown in FIG. 1 (*b*). Then a steel reinforcing cage 3 is inserted, concrete 5 is placed between the pipes 4 as shown in FIG. 1 (*c*), and the pipes 4 are pulled out two or three hours after the placing of concrete 5.

After the construction of the first wall panel 5, excavation and concreting of the third panel 6 is carried out, the second panel being skipped. After finishing of the third panel 6, the second panel 7 between the first panel and the third panel is excavated and concrete 8 is placed as shown in FIG. 1 (*d*).

However, the use of interlocking pipes may create a problem that, as shown in FIG. 3 (*a*), slime and clay 15 are sandwiched between the concrete at the ends of the adjacent wall panels, with the result that the concrete of wall panels does not stick together tightly. In an effort to overcome this problem a special joint as shown in FIG. 2 has been used. In this case, reinforcing steel cage 303 is placed in the trench of the preceding panel and a steel plate of suitable thickness 11 is welded to the steel cage near the end by means of a steel bar 10 and a vinylon sheet 13 is attached to the steel plate 11 by a metallic clamp 12. The vinylon sheet 13 is pressed against the wall faces of the trench by spacers 14 to prevent the leakage of fresh concrete outside the vertical steel plate.

After finishing of a preceding panel, at an adjoining section a convex or projecting portion of a steel cage 304 of special shape is inserted in the concave or recessed portion of the steel cage 303 of the preceding wall panel and thus a concrete wall having the reinforcing steel cages overlapped is formed.

In the above-described conventional method, however, even if slime and lumps of clay are removed before the steel cage is inserted, very fine soil particles in slurry-like muddy water will settle as a slime and also when placing the concrete, the concrete will not displace the muddy water completely. Therefore, where interlocking pipes are used or where the joint structure is complicated as shown in FIG. 2, slime and clay 15 and 16 are sandwiched in the construction joints of wall panels as shown in FIG. 3 (*a*) and FIG. 4 (*a*) respectively and it is often experienced that in excavating the ground surrounded by diaphragm walls, constructed in this manner water leaks through such construction joints and the leakage can cause settlement of the adjacent ground and other troubles.

The present invention relates to the method which overcomes these problems by constructing diaphragm walls which have high strength and are free from leakage by jetting cement milk at a high pressure against slime and lumps of clay present at the joint part of the diaphragm walls so as to eliminate the slime entirely.

The present invention is an improvement on the slurry trench method for constructing continuous reinforced concrete walls under the ground by excavating a trench while preventing lateral movement of the wall faces by using a suspension of bentonite, for example, and by inserting a reinforcing steel cage and placing concrete in the trench. According to the present invention, a trench for the wall panel adjoining the wall panel which has previously been cast is excavated and when a steel cage is inserted into said trench, at least one injection pipe supported by an annular metal bracket on the end of the steel cage is also inserted, along with the steel cage or after the steel cage is placed in its position. After placing concrete in this panel by means of tremie or other methods, and before the concrete begins to set a suspension of Portland cement in water is jetted into the fresh concrete at a pressure high enough to sweep the slime adhered to the end of the preceding wall panel off said end, e.g. a pressure of 100–300 $Kg/cm^2$, from a horizontal nozzle at the tip of said injection pipe and then said injection pipe is rotated and pulled up while continuing the jetting. Thus, clay or slime such as bentonite which would otherwise remain between the end faces of the preceding concrete wall sand and the concrete wall panel being formed is dispersed so that diaphragm wall panels will be joined tightly and the joints between the panels will not leak.

The nature and advantages of the present invention will be understood more clearly from the following description made with reference to a preferred embodiment and accompanying drawings, in which:

FIGS. 1*a*–1*d* are schematic views showing the steps employed in the prior art method of constructing diaphragm walls;

FIG. 2 is a section through a special joint used in the prior art method of FIGS. 1*a*–1*d;*

FIGS. 3*a* and 3*b* are a horizontal and a vertical section, respectively showing slime sandwiched between wall panels in the method of FIGS. 1*a*–1*d* and using interlocking pipes;

FIGS. 4*a* and 4*b* are a horizontal and a vertical section, respectively, showing slime sandwiched between wall panels in the prior art method using the special joint of FIG. 2;

Figure 5:
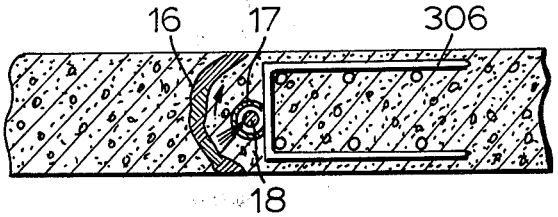
FIG. 5 is a horizontal sectional view showing the constructing method according to the present invention using interlocking pipes.

Shown in FIG. 5 is a sectional plan view illustrating an embodiment of the method of the present invention using interlocking pipes. In this figure, numeral 306 designates a reinforcing steel cage placed in the excavation for the panel being cast. Numeral 17 designates an annular metal bracket or holder, of steel for example, provided at several points vertically spaced along the steel cage. Numeral 18 designates an injection pipe inserted through the brackets 17.

After completing preceding panels 5 and 6 as described in connection with FIG. 1 (*c*), a trend for an intermediate panel 7 is excavated. After excavation of the trench for the panel 7 and removal of slime therefrom, the steel cage 306 (shown in FIG. 5) with the injection pipe 18 held in the steel brackets 17 is placed in the trench. In the case where the trench is so deep that several steel cages must be used, the steel cages are joined together and also the injection pipes are joined while they are inserted. After the steel cage 306 and the injection pipe 18 have been inserted properly, a plurality of tremies are suspended through the steel cage to place concrete in the trench in the conventional manner. When the height of concrete placed in this trench rises to 2 or 3 meters, the injection pipe 18 is supplied with a suspension of Portland cement in water from a high pressure pump (not shown in the drawing) via a high pressure pipe (not shown in the drawing). At this time, the injection pipe 18 is pulled up slowly while it is rotated by a boring machine (not shown in the drawing) installed on the ground and above the injection pipe. The Portland cement suspension thus supplied through the injection pipe is jetted powerfully from a horizontal jetting nozzle at the lower end of the injection pipe, into fresh concrete 8 which has not yet set. If the injection pipe 18 is positioned about 20–30 c.m. away from the end face of the preceding concrete panel, slime 16 sandwiched between the end of the preceding panel and the fresh concrete is dispersed and mixed into the fresh concrete by the fracturing and agitating effect of jet. Therefore, the layer of slime which was present along the whole joint between the wall panels is removed as the injection pipe is pulled up while it is rotated and the Portland cement suspension is jetted from the nozzle. Where the thickness of the underground wall is too large to remove slime from the whole width of the joint by means of one injection pipe, a plurality of injection pipes may be used with the number depending on the jetting pressure and effective jet length.

Figure 1A:
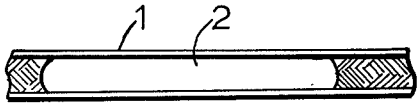
PRIOR ART FIG.1a
Figure 1B:
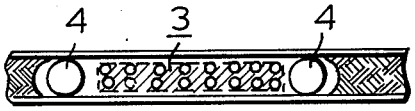
PRIOR ART FIG.1b
Figure 1C:
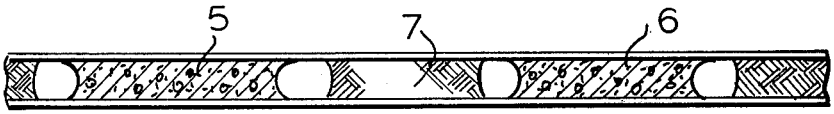
PRIOR ART FIG.1c
Figure 1D:
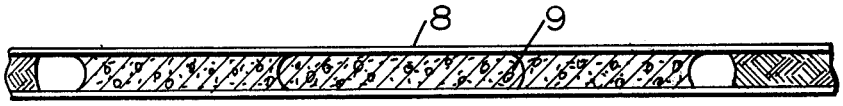
PRIOR ART FIG.1d
Figure 2:
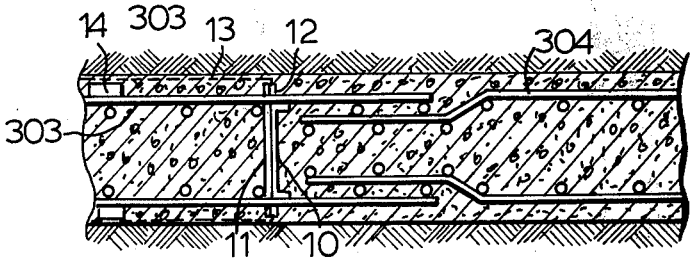
PRIOR ART FIG.2
Figure 3A:
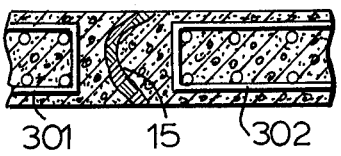
FIG.3a PRIOR ART
Figure 4A:
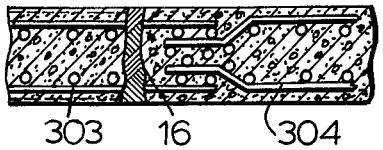
FIG.4a PRIOR ART
Figure 3B:
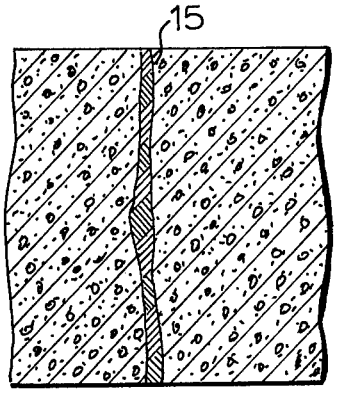
PRIOR ART FIG.3b
Figure 4B:
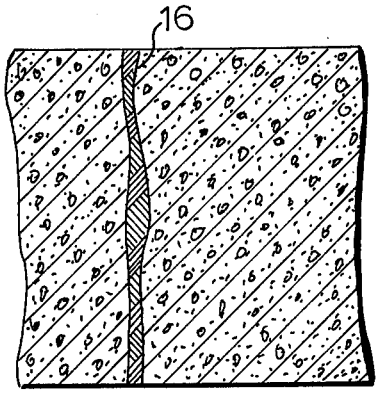
PRIOR ART FIG.4b
Figure 7:
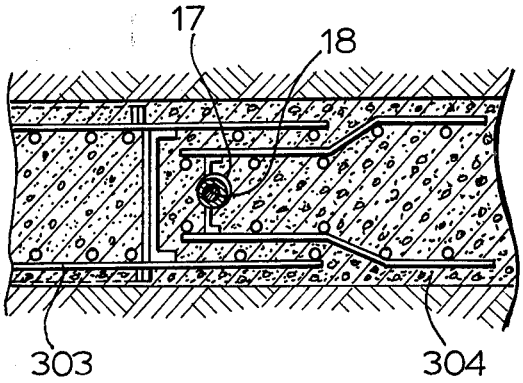
FIG. 7 is a view similar to FIG. 5 showing the method of the present invention using special joints.

FIG. 7 shows the positioning of an injection pipe in the case where a special joint as shown in FIG. 2 and FIGS. 4*a* and 4*b* is used. In FIG. 7, numeral 303 designates a reinforcing steel cage placed in the preceding concrete panel. Numeral 304 designates a steel cage for the panel being case. Numeral 17 designates an annular steel holder and numeral 18 designates an injection pipe.

Figure 6:
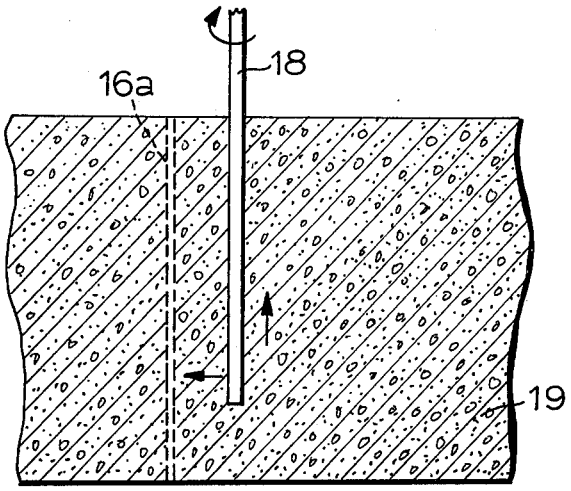
FIG. 6 is a vertical view thereof.

FIG. 6 is a schematic side view showing an injection pipe being pulled up as it is jetting the Portland cement suspension against the joint and around the injection pipe. Numeral 16*a* designates the joint between the wall panels. Numeral 18 designates an injection pipe and numeral 19 designates the area where the Portland cement suspension is jetted and unset concrete is stirred.

Since the placing of concrete for the diaphragm walls is carried out in the bentonite suspension, the standard proportion is a water-cement ratio 55%, with the quantity of cement around 390 kg/m$^3$. The strength of the concrete of the wall in the case where a cement suspension with a 111% water-cement ratio was used, was measured experimentally. The result of this measuring has revealed that if jetting is effected immediately after placing of the concrete, surplus water in the concrete, which is still in a fluid state, rises due to a bleeding phenomenon and comes out of the surface of the concrete as excess as bleeding water. Thus, lowering of strength due to existence of surplus water is be eliminated.

With regard to the effect of slime dispersed in the concrete, because the quantity of the slime is very small in comparison with the quantity of concrete stirred by the jet and also because the absolute quantity of Portland cement increases due to the addition of the Portland cement suspension through the injection pipe, concrete in the area which was subjected to jetting and agitating, namely, concrete in the area 19 shown in FIG. 6, has a higher strength than the concrete of the other portions of the wall. Thus, the portion around the joint which is the weakest portion of the diaphragm wall is reinforced and continuous walls of high overall quality can be formed.

Because of resistance to rotation and pulling up of the injection pipe due to the setting of the concrete, in the case where it takes three or four hours to place the concrete for deep diaphragm walls or for diaphragm walls of having a large thickness, the injection pipe should be rotated at the time of starting to place the concrete and when half or one-third of the concrete has been placed, jetting should be started.

Thus, according to the present invention, before the panels forming the diaphragm walls are joined and concrete is placed, an injection pipe is inserted along with a steel cage or following the placement of the steel cage, and then concrete is placed, and before the concrete begins to set, a suspension of cement in water is jetted at a high pressure against the joint of the wall panels. Accordingly, slime and clay sandwiched between the end faces of wall panels can be completely dispersed by the fracturing and agitating effect of the jet and surplus water in the jetted suspension is removed by the bleeding phenomenon. Thus, the present invention has such advantages that the strength of the diaphragm wall concrete is not reduced and water leakage at the joints in the diaphragm walls is prevented. Moreover, the present invention provides a very simple constructing method which requires is carried out only at the joints in the diaphragm walls at intervals of 5–8 meters.

What is claimed is:

1. In a method of constructing a panel of a continuous diaphragm wall of reinforced concrete under the ground by excavating a trench in the ground adjacent one end of a previously cast panel and preventing collapse of the trench wall faces by filling the trench with a suspension of bentonite or the like in water and then inserting a reinforcing steel cage in the trench and filling the trench with concrete to replace the suspension, the improvement comprising inserting at least one injection pipe into said trench at a position adjacent the end of the previously cast panel and at a time prior to filling the trench with concrete, rotating said injection pipe about its own axis starting at a time no earlier than the start of filling the trench with concrete, and thereafter, before the concrete begins to set, jetting a suspension of cement in water through said injection pipe and laterally of the lower end of said pipe while simultaneously pulling the injection pipe out of the concrete in the trench, the pressure of the suspension being sufficient to cause the jet moving laterally of the injection pipe to remove any clay or slime of bentonite or the like from the end of the previously cast panel and disperse it in the unset concrete, whereby the joint between the previously cast panel and the panel being cast is tight and prevents water leakage through the diaphragm wall.

2. The improvement as claimed in claim 1 in which the pressure of the jetted suspension is from 100–300 $Kg/cm^2$.

3. The improvement as claimed in claim 1 in which the injection pipe is inserted with the reinforcing steel cage and is supported on said cage.

4. The improvement as claimed in claim 1 in which the injection pipe is inserted separately from the reinforcing cage.

* * * * *

UNITED STATES PATENT AND TRADEMARK OFFICE

CERTIFICATE OF CORRECTION

PATENT NO. : 4,146,348

DATED : March 27, 1979

INVENTOR(S) : Kenji Kawasaki

It is certified that error appears in the above–identified patent and that said Letters Patent are hereby corrected as shown below:

Column 4, line 6, change "111%" to -- 1/1 --;

Column 4, line 13, change "is" to -- can --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*